United States Patent [19]

Stiemert

[11] 4,145,062

[45] Mar. 20, 1979

[54] SNOW SCRAPER

[76] Inventor: Cyrus R. Stiemert, 4451 145th Ave., SE., Bellevue, Wash. 98006

[21] Appl. No.: 746,404

[22] Filed: Dec. 1, 1976

[51] Int. Cl.[2] ..... A63C 11/22; A47L 23/04

[52] U.S. Cl. ..... 280/11.37 E; 15/237

[58] Field of Search ..... 15/111-113, 15/237; 24/279, 280, 284; 280/11.37 A, 11.37 E, 11.37 T, 16.4 A

[56] References Cited

U.S. PATENT DOCUMENTS

| | | | |
|---|---|---|---|
| 732,309 | 6/1903 | Marshall | 24/280 X |
| 1,186,901 | 6/1916 | Higgins | 24/279 UX |
| 2,512,952 | 6/1950 | MacMartin | 15/236 X |
| 3,041,650 | 7/1962 | Day | 15/236 R |
| 3,350,111 | 10/1967 | Sahlein et al. | 280/11.37 E |
| 3,929,345 | 12/1975 | Nasby et al. | 280/11.37 E |
| 4,000,909 | 1/1977 | Coale | 15/237 |

FOREIGN PATENT DOCUMENTS

| | | | |
|---|---|---|---|
| 600189 | 6/1960 | Canada | 24/279 |
| 373678 | 6/1932 | United Kingdom | 24/279 |

*Primary Examiner*—Daniel Blum

*Attorney, Agent, or Firm*—Christensen, O'Connor, Johnson & Kindness

[57] ABSTRACT

A snow scraper attached to a ski pole shaft includes an elongated member having an exterior surface and a wall. The ski pole shaft extends through a longitudinally oriented, cylindrical channel in the member. The member has a substantially planar exterior surface portion oriented tangentially to the channel and spaced outwardly from the channel. A radial slot extends from the channel perpendicularly toward and intersects the substantially planar exterior surface portion. Two longitudinally extending edges are defined by second and third exterior surface portions that intersect with the substantially planar exterior surface portion. Inwardly concave, exterior surface portions are located between the edge and the channel in the sidewall of the member. A means for clamping the member to a ski pole shaft is also included.

6 Claims, 4 Drawing Figures

SNOW SCRAPER

BACKGROUND OF THE INVENTION

The present invention relates to snow scrapers and more particularly to a snow scraper designed for attachment to a ski pole.

When a skier encounters certain types of snow conditions, especially conditions where ambient temperatures are relatively high and the surface snow is relatively wet and sticky, a build-up of snow can accumulate on his ski boot soles. This snow must be removed prior to insertion of the boot into a ski binding so that a proper fit will be obtained and so that the snow will not freeze once the ski is in the binding, preventing the boot and binding from properly releasing during use. In the past, skiers have cleaned snow from their boots by hand or by using the tip of a ski pole. These methods are unsatisfactory as complete cleaning of the boot sole is difficult to achieve.

Several different boot scrapers have been suggested. These include hand scrapers carried in a skier's pocket and devices adapted for attachment to a ski pole. Hand scrapers are just one additional piece of paraphernalia for which a skier must find a storage place on his person, and thus are unsatisfactory for that reason alone. In addition, snow scrapers and other objects carried in a pocket can easily be lost and can even cause injury to the skier during a fall. Snow scrapers of the prior art adapted for attachment to a ski pole normally have a scraper member projecting outwardly from the pole. Any such projecting member can be dangerous to the skier during a fall and is also subject to breakage. One such prior art scraper has a flange that extends radially from the pole and includes a means for clamping the flange to the pole. The scraping edge is spaced a substantial distance from the axis of the pole. This device is not securely affixed to the pole and can rotate about the pole when the scraper edge is being used, reducing the scraping efficiency of the device and requiring the device to be, in essence, held in the hand during use.

It is a broad object of the present invention to provide an improved snow scraper for ski boots. Further objects of the present invention are: to provide a snow scraper that attaches to a ski pole; to provide a snow scraper that is so secured to a ski pole to prevent it from rotating about the pole during use; to provide a snow scraper that will not tend to cause the ski pole to turn by torsional forces transmitted to the pole from the scraper edge during use; to provide a snow scraper that is easy for a skier to use from a standing position; to provide a snow scraper that has a one-piece construction; to provide a snow scraper that is easy to mount on a ski pole and that cannot be disengaged from the pole under ordinary use; and to provide a safe, strong and economically manufactured snow scraper.

SUMMARY OF THE INVENTION

In accordance with the foregoing objects and other objects that will become apparent to one of ordinary skill upon reading the following specification, the present invention provides a snow scraper for attachment to a ski pole shaft. The scraper comprises an elongated member having a wall and an exterior surface. The wall defines a channel through the member oriented along the longitudinal dimension of the member. The channel is so sized and shaped as to surround the ski pole shaft. The member has at least one longitudinally oriented edge formed by two intersecting exterior surface portions of the wall. One of the exterior surface portions is substantially planar and is oriented substantially parallel to a tangent to the ski pole on which it is mounted. The substantially planar surface is also spaced outwardly from the channel and thus from the pole. The wall further has a longitudinal slot therein communicating between the channel and the exterior surface of the member. An attachment means for reducing the slot width is provided for securely clamping the member to a ski pole shaft.

BRIEF DESCRIPTION OF THE DRAWINGS

A better understanding of the present invention can be derived by reading the ensuing specification in conjunction with the accompanying drawings wherein.

DETAILED DESCRIPTION

Figure 1:
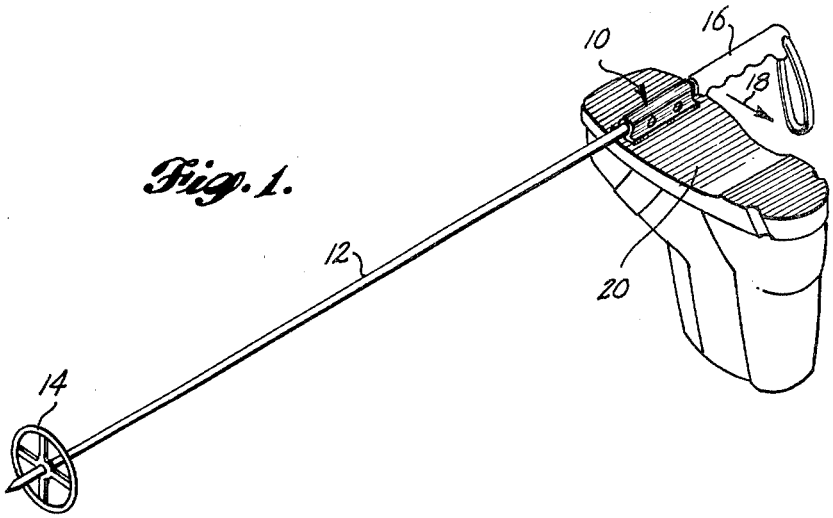
FIG. 1 is an isometric view of the snow scraper of the present invention attached to a ski pole and shown in use scraping snow from a ski boot.

Referring first to FIG. 1, a snow scraper, generally designated 10, is attached to the shaft 12 of a ski pole at a location opposite the basketed end 14 of the pole and adjacent the end of the pole carrying the hand grip 16. The snow scraper 10 has one generally planar, exterior surface that engages the boot sole. The scraper is then moved in a direction transverse to its longitudinal dimension (indicated by arrow 18) over the sole 20 of the ski boot to remove accumulated snow. The snow scraper is intended for use by a skier with his boots on when he is readying his boot for insertion into a ski binding. For ease of illustration, the ski pole, ski boot, and the snow scraper are shown in inverted relationship from that in which they are normally used. In other words, the boot sole will generally be positioned facing the ground and parallel to or angulated relative to the ground plane during use and will not be up-sidedown as shown in FIG. 1. Thus in actual use the snow scraper will be positioned under the boot with its planar guide surface engaging the boot sole.

Figure 2:
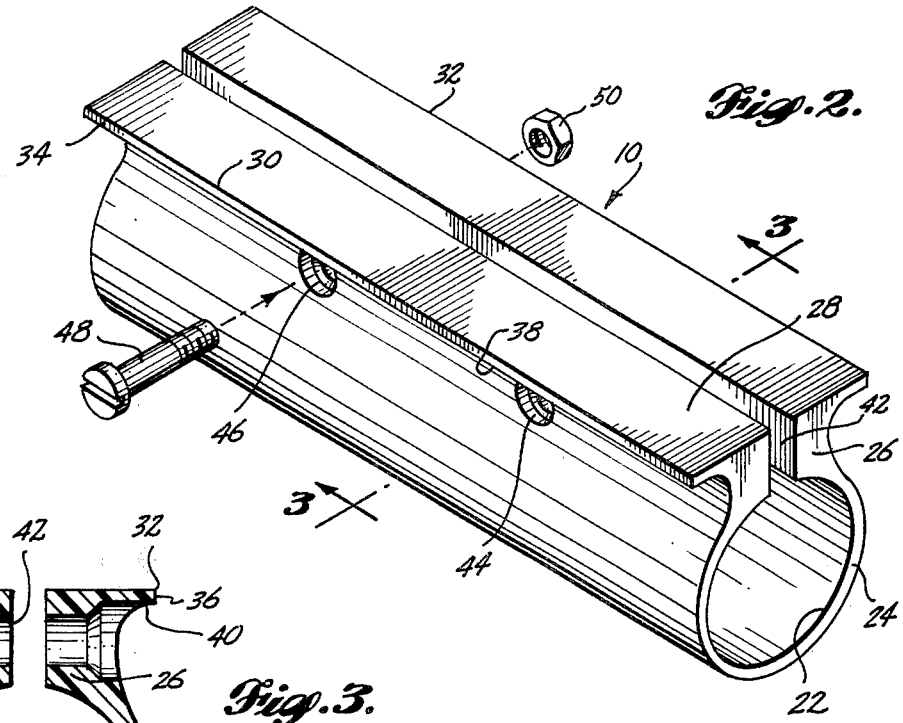
FIG. 2 is an isometric view of the snow scraper of the present invention.
Figure 3:
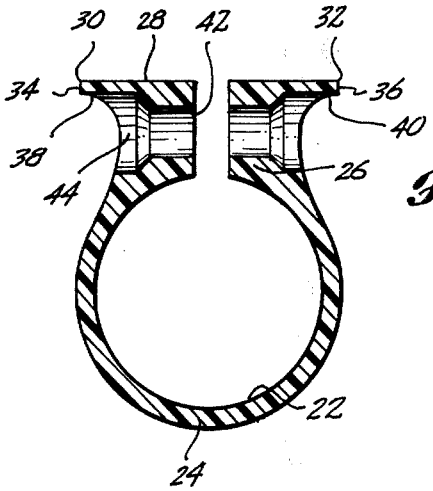
FIG. 3 is a cross-sectional view taken along section line 3—3 of FIG. 2.

Referring to FIGS. 2 and 3, the snow scraper 10 is an elongated member having a central, cylindrically shaped channel or bore 22 surrounded by an annularly shaped wall 24. The upper quadrant of the annularly shaped wall 24 has an enlarged wall portion 26, i.e., has a wall portion with a greater thickness than the remainder of the wall, that forms an elongated projection 26 extending outwardly from the wall. The upper surface of the enlarged wall portion 26 is generally planar and is preferably oriented parallel to a tangent to the cylindrical channel 22 and parallel to the longitudinal axis of the ski pole. The exterior surface 28 of the enlarged wall portion is substantially planar and extends along the entire length of the snow scraper 10. Although the exterior surface 28 is hereafter referred to as planar, it is to be understood that a slight curvature or minor deviation from a truly planar surface are acceptable and will function within the scope of the invention. Cutting edges 30 and 32 are formed at the sides of the planar surface 28 by exterior edge surfaces 34 and 36 that are oriented perpendicularly to the upper planar surface 28. The edges 30 and 32 thus form the cutting edges for removing snow from a boot.

During use, the planar surface 28 is positioned on the boot sole and is moved across the boot sole during use. The planar surface 28 is preferably slightly wider than the diameter of the interior channel. During use, the planar surface is maintained in contact with the boot sole, functioning as a guide surface that will counteract the torsional forces otherwise transmitted through the scraper to the pole. The guide surface then assists in preventing the ski pole from rotating about its longitudinal axis during use and in preventing the scraper from rotating about the ski pole.

Concave, exterior surface portions 38 and 40 are provided in the enlarged portion 26 of the scraper wall between the channel 22 and the cutting edge 30 formed by the intersection of the upper planar surface 28 and the perpendicularly oriented edge surfaces 34 and 36. During use, these concave surfaces tend to lift snow from the boot, causing it to curl outwardly away from the boot and thus increase the ease with which snow can be removed form the boot.

A longitudinally extending slot 42 extends from the cylindrical channel 22 radially outwardly toward the planar surface 28 and is oriented perpendicularly to the planar surface 28. The annular wall 24 is sufficiently flexible in the region opposite the slot so that the width of the slot can be increased or reduced to slightly vary the diametric size of the cylindrical channel 22, thus allowing the cylindrical channel 22 to be tightly clamped about a ski pole shaft. Two tangential bores 44 and 46 spaced from each other along the longitudinal dimension of the scraper 10, oriented tangentially to the cylindrical channel 22, and extending between opposite ones of the concave, exterior surfaces 38 and 40 are provided. Suitable fasteners such as a nut 50 and bolt 48 can be inserted through each of the bores 44 and 46 and tightened down to securely clamp the snow scraper 10 to the ski pole shaft. Since the scraper is secured to the ski pole, it cannot become accidentally detached and consequently subject to loss. Further, the scraper can be preset at a given angular position on the pole relative to the hand grip and once secured will not rotate on the pole during use.

Figure 4:
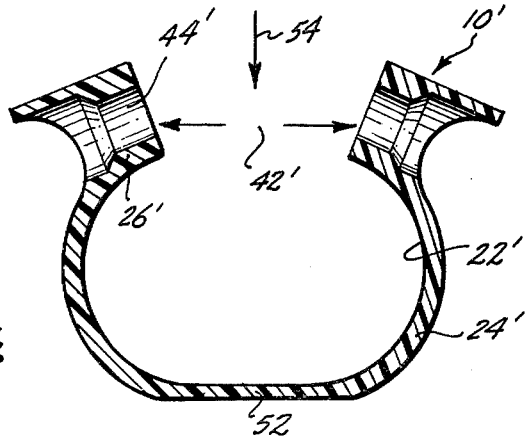
FIG. 4 is a cross-sectional view somewhat similar to FIG. 3 showing an alternate embodiment of the present invention.

An alternate embodiment of the invention is shown in FIG. 4 wherein the width of the gap 42' is significantly increased over the embodiment just described to a dimension slightly greater than the diameter of the ski pole. The portion of the annular wall 24' diametrically opposite the slot 42' has a longitudinally extending zone of weakness 52. The zone of weakness 52 can be formed in the scraper wall by reducing the wall thickness, by providing a slot or groove in the wall or by any other suitable means. In this embodiment of the invention, a ski pole shaft can be inserted into the channel 22' through the slot 42' in a direction transverse to the shaft and the scraper, as indicated by the arrow 54. Thereafter, the spread-apart halves of the enlarged wall portion 26' are forced together and fasteners inserted through the bore 44' to securely clamp the scraper to the pole shaft in a manner similar to the first-described embodiment.

The snow scraper of the present invention can be molded or extruded from a synthetic polymeric material, preferably a polytetrafluoroethylene, or can be, and preferably is, extruded from lightweight metal such as an aluminum alloy. If desired, the ski scraper can be anodized or coated with a material that will prevent snow from sticking to it during use.

The foregoing invention has been described in relation to a preferred embodiment and an alternate thereof. One of ordinary skill, after reading the foregoing specification, will be able to effect various alterations, substitutions of equivalents, and other changes without departing from the broad concepts disclosed herein. It is therefore intended that the grant of Letters Patent on the invention disclosed herein be limited only by the definition contained in the appended claims and equivalents thereof.

What is claimed is:

1. A snow scraper for attachment to a ski pole shaft comprising:

a unitary elongated member having a wall, said wall defining an elongated channel through said member oriented longitudinally along said member, said channel being substantially cylindrical so as to circumscribe said ski pole shaft, said member having at least one longitudinally oriented, straight scraping edge formed by first and second intersecting exterior surface portions of said wall, said first surface portion being substantially planar and being oriented substantially parallel to a tangent to said channel and being spaced outwardly from said channel, said wall having a longitudinal slot therein extending from said channel to the plane of said first surface portion, said edge being laterally offset from said slot, said wall having a concave exterior surface portion adjacent said edge, said concave surface portion being located in said wall between said first surface portion and said channel and intersecting said second surface portion, and attachment means for securing said member to a ski pole shaft by decreasing the width of said slot and thereby reducing the diametric dimension of said channel to place the surface of said channel in intimate contact with said ski pole shaft, said attachment means being located between the plane of said first surface portion and said channel.

2. In combination, a snow scraper for attachment to a ski pole shaft, said ski pole shaft having a basketed end, a grip end, and a hand grip affixed to said grip end, comprising:

a unitary elongated member having a wall, said wall defining an elongated channel through said member oriented longitudinally along said member, said channel being substantially cylindrical so as to circumscribe said ski pole shaft, said member having at least one longitudinally oriented, scraping edge formed by first and second intersecting exterior surface portions of said wall, said first surface portion being substantially planar and being oriented substantially parallel to a tangent to said channel and being spaced outwardly from said channel, said wall having a longitudinal slot therein extending from said channel to said first surface portion, said member being positioned adjacent and below said grip on said ski pole shaft, and attachment means for securing said member to a ski pole shaft by decreasing the width of said slot and thereby reducing the diametric dimension of said channel to place the surface of said channel in intimate contact with said ski pole shaft, said attachment means being located between the plane of said first surface portion and said channel.

3. A snow scraper for attachment to a ski pole shaft comprising:

a unitary elongated member having a wall, said wall defining an elongated channel through said member oriented longitudinally along said member, said channel being substantially cylindrical so as to circumscribe said ski pole shaft, said member having at least one longitudinally oriented, scraping edge formed by first and second intersecting exterior surface portions of said wall, said first surface portion being substantially planar and being oriented substantially parallel to a tangent to said channel and being spaced outwardly from said channel, said wall having a longitudinal slot therein extending from said channel to said first surface portion, said slot being oriented perpendicularly to said first surface portion and radially relative to said channel, said member having a second longitudinally oriented, scraping edge spaced from said one edge and being formed by the intersection of a third surface portion and a fourth surface portion, said fourth surface portion being substantially planar and oriented substantially parallel to a tangent to said channel and being spaced outwardly from said channel, said one edge and said second edge being located on opposite sides of said slot, said member further including first and second concave surface portions located adjacent respective ones of said second surface portion and said third surface portion adjacent respective ones of said edges, and attachment means for securing said member to a ski pole shaft by decreasing the width of said slot and thereby reducing the diametric dimension of said channel to place the surface of said channel in intimate contact with said ski pole shaft, said attachment means being located between the plane of said first surface portion and said channel.

4. A snow scraper for attachment to a ski pole shaft comprising:

a unitary elongated member having a wall, said wall defining an elongated channel through said member oriented longitudinally along said member, said channel being substantially cylindrical so as to circumscribe said ski pole shaft, said member having at least one longitudinally oriented, scraping edge formed by first and second intersecting exterior surface portions of said wall, said first surface portion being substantially planar and being oriented substantially parallel to a tangent to said channel and being spaced outwardly from said channel, said wall having a longitudinal slot therein extending from said channel to said first surface portion, said wall having a zone of weakness extending longitudinally of said member, said zone of weakness being located in said wall on the opposite side of said channel from said slot, said member being deformed so that the width of said slot corresponds to the effective diametric dimension of said ski pole shaft, said member being capable of bending along said zone of weakness after said scraper is positioned on said shaft so as to move the opposing portions of said member on each side of said slot in a direction transverse to the longitudinal dimension of said shaft and said member to thereby decrease the width of said slot and cause said member to frictionally contact said pole, and attachment means for securing said member to a ski pole shaft by decreasing the width of said slot and thereby reducing the diametric dimension of said channel to place the surface of said channel in intimate contact with said ski pole shaft, said attachment means being located between the plane of said first surface portion and said channel.

5. A snow scraper for attachment to a ski pole shaft comprising:

a unitary elongated member having a wall, said wall defining an elongated channel through said member oriented longitudinally along said member, said channel being substantially cylindrical so as to circumscribe said ski pole shaft, said member having at least one longitudinally oriented, scraping edge formed by first and second intersecting exterior surface portions of said wall, said first surface portion being substantially planar and being oriented substantially parallel to a tangent to said channel and being spaced outwardly from said channel, said wall having a longitudinal slot therein extending from said channel to said first surface portion, said wall having a zone of weakness running longitudinally along said member, said zone of weakness being located in said wall on the opposite side of said channel from said slot, and attachment means for securing said member to a ski pole shaft by decreasing the width of said slot and thereby reducing the diametric dimension of said channel to place the surface of said channel in intimate contact with said ski pole shaft, said attachment means being located between the plane of said first surface portion and said channel.

6. The snow scraper of claim 5 wherein the thickness of said wall adjacent said slot is greater than the thickness of the portion of said wall having said zone of weakness.

* * * * *